US007434967B2

(12) United States Patent
Dupre

(10) Patent No.: US 7,434,967 B2
(45) Date of Patent: Oct. 14, 2008

(54) WORM GEAR DRIVE AIMING AND LOCKING MECHANISM

(75) Inventor: Scott Dupre, Fall River, MA (US)

(73) Assignee: Genlyte Thomas Group, LLC, Louisville, KY (US)

( * ) Notice: Subject to any disclaimer, the term of this patent is extended or adjusted under 35 U.S.C. 154(b) by 108 days.

(21) Appl. No.: 11/065,920

(22) Filed: Feb. 25, 2005

(65) Prior Publication Data

US 2006/0193142 A1 Aug. 31, 2006

(51) Int. Cl.
*F21V 15/00* (2006.01)

(52) U.S. Cl. ..... 362/366

(58) Field of Classification Search ..... 362/366
See application file for complete search history.

(56) References Cited

U.S. PATENT DOCUMENTS

| | | | | |
|---|---|---|---|---|
| 2,716,185 | A | 8/1955 | Burliuk et al. | |
| 2,855,503 | A | 10/1958 | Gerstel | |
| 2,922,030 | A | 1/1960 | Bobrick | |
| 2,922,032 | A | 1/1960 | Haas et al. | |
| 2,966,325 | A | 12/1960 | Pascucci | |
| 2,973,177 | A | 2/1961 | Stubbs | |
| 3,007,040 | A * | 10/1961 | Schwartz | 362/269 |
| 3,388,247 | A | 6/1968 | Rackley | |
| 3,609,346 | A | 9/1971 | Lund et al. | |
| 3,660,651 | A | 5/1972 | Miles, Jr. | |
| 4,048,491 | A | 9/1977 | Wessman | |
| 4,306,279 | A | 12/1981 | Cohen | |
| 4,623,956 | A * | 11/1986 | Conti | 362/364 |
| 4,707,768 | A | 11/1987 | Ball | |
| 5,017,327 | A | 5/1991 | Bamber | |
| 5,077,650 | A | 12/1991 | Cestari | |
| 5,130,903 | A * | 7/1992 | Fast et al. | 362/466 |
| 5,140,507 | A | 8/1992 | Harwood | |
| 5,325,281 | A | 6/1994 | Harwood | |
| 5,331,531 | A | 7/1994 | Unger et al. | |
| 5,452,193 | A | 9/1995 | Hinnefeld et al. | |
| 5,562,343 | A | 10/1996 | Chan et al. | |
| 5,823,664 | A | 10/1998 | Demshki, Jr. et al. | |
| RE36,004 | E | 12/1998 | Hinnefeld et al. | |
| 5,855,427 | A | 1/1999 | Lassovsky | |
| 5,951,151 | A | 9/1999 | Doubeck et al. | |
| 6,082,878 | A | 7/2000 | Doubeck et al. | |
| 6,095,660 | A | 8/2000 | Moriyama et al. | |

(Continued)

FOREIGN PATENT DOCUMENTS

| | | | |
|---|---|---|---|
| JP | 2094206 | A | 3/1991 |

*Primary Examiner*—Ali Alavi
*Assistant Examiner*—William J Carter
(74) *Attorney, Agent, or Firm*—James E. Cole; Middleton Reutlinger

(57) ABSTRACT

According to a one embodiment of the instant invention an adjustable downlight assembly comprises a collar, a yoke adjustable through an arcuate distance, the yoke pivotally connected to the collar, and a worm gear drive assembly operably engaging the yoke and the collar for pivoting the yolk about a horizontal axis. The worm gear drive assembly comprises a worm and a gear. The worm gear drive assembly is adjustable by rotation of the worm. The adjustable downlight assembly further comprises a biasing member fastened to a casting, the casting extending from an inner surface of the collar. The worm gear drive assembly inhibits unintentional movement of the yoke after adjustment is completed.

31 Claims, 8 Drawing Sheets

U.S. PATENT DOCUMENTS 6,315,439 B1 11/2001 Denley
6,332,695 B1 12/2001 Wang
6,471,374 B1 10/2002 Thomas et al.
6,607,292 B2 8/2003 Gutierrez et al.
6,652,124 B2 11/2003 Schubert et al.
6,883,935 B2 4/2005 Lassovsky
7,156,541 B2 * 1/2007 Yeung ..... 362/428
2003/0161153 A1 8/2003 Patti

* cited by examiner

WORM GEAR DRIVE AIMING AND LOCKING MECHANISM

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present invention provides a worm gear drive aiming mechanism for a recessed downlight fixture. More specifically, the present invention comprises an aiming mechanism for a recessed downlight fixture as well as a rotation mechanism and locking mechanism for the rotation mechanism on the fixture.

2. Description of the Related Art

Recessed downlight fixtures have become increasingly popular for residential and commercial use. One reason for the increased popularity is that the recessed downlight fixtures is that they meet a wide range of interior lighting requirements while also being aesthetically pleasing. Further these recessed downlight fixtures may be installed in new constructions as well as existing ceilings. Typically, ceiling-mounted recessed downlight fixtures comprise a frame with means for securing the frame to structural supports of the ceiling. For installation, the frame of the light fixture may include holes or brackets through which fasteners are used to position and attach the fixture to the supports.

As the popularity of recessed lighting has increased, a need for aiming or adjustability of the luminaire output has also increased. Aiming of a light pattern is of particular importance in certain lighting applications such as at a museum for highlighting a work, or in corner lighting applications or wall wash applications. Prior art recessed downlight fixtures fail to provide easy adjustment of the luminaire pattern. For example, many fixtures require adjustment by hand that can lead to skin contact with heated elements of the lighting fixture, and resulting in burns. When high intensity discharge lamps are utilized, placing a hand on or near the lamp is hazardous due to the high temperatures of the bulbs. Further, due to the size of the fixtures, most lighting trims provide very little room for positioning of a hand in order to adjust or aim the light pattern. Also prior art adjustment mechanisms may result in misalignment as a result of unsmooth or unstable adjustment mechanisms. Also during an aiming process, the user's hand or an adjustment tool typically blocks the light emitted from within the fixture because a user has to position their hand within the fixture to adjust it. Finally, prior art adjustable fixtures often times fail to maintain an adjusted position once the aiming process is complete. This results in aiming processes which take longer or repeated processes, which waste both time and money.

Thus there is a need for a fixture which allows aiming by a user without a hand being in close proximity to a lamp, which further allows adjustment or aiming without blocking the output light, and which does not allow the fixture to become misaligned after aiming is complete.

SUMMARY OF THE INVENTION

According to a one embodiment of the instant invention an adjustable downlight assembly comprises a collar, a yoke adjustable through an arcuate distance, the yoke pivotally connected to the collar, and a worm gear drive assembly operably engaging the yoke and the collar for pivoting the yolk about a horizontal axis. The worm gear drive assembly comprises a worm and a gear. The worm gear drive assembly is adjustable by rotation of the worm. The adjustable downlight assembly further comprises a biasing member fastened to a casting, the casting extending from an inner surface of the collar. The worm gear drive assembly inhibits unintentional movement of the yoke after adjustment is completed.

According to a second embodiment, the collar may be a rotating collar assembly. The rotating collar assembly may comprise an outer race and an inner race, wherein the inner race rotates relative to the outer race. The rotating collar assembly may further comprise a brake and a rotation stop limiting rotation of the collar assembly to a preselected angular distance and inhibiting wire twisting. The rotation stop may extend from one of the inner race and the outer race.

The adjustable downlight assembly further comprises a filter cartridge retaining member. The filter cartridge retaining member extends between first and second legs of said yoke. The filter cartridge retaining member may comprise a magnet for retaining a filter cartridge. The downlight assembly is adjustable about first and second axes.

DETAILED DESCRIPTION

Figure 1:
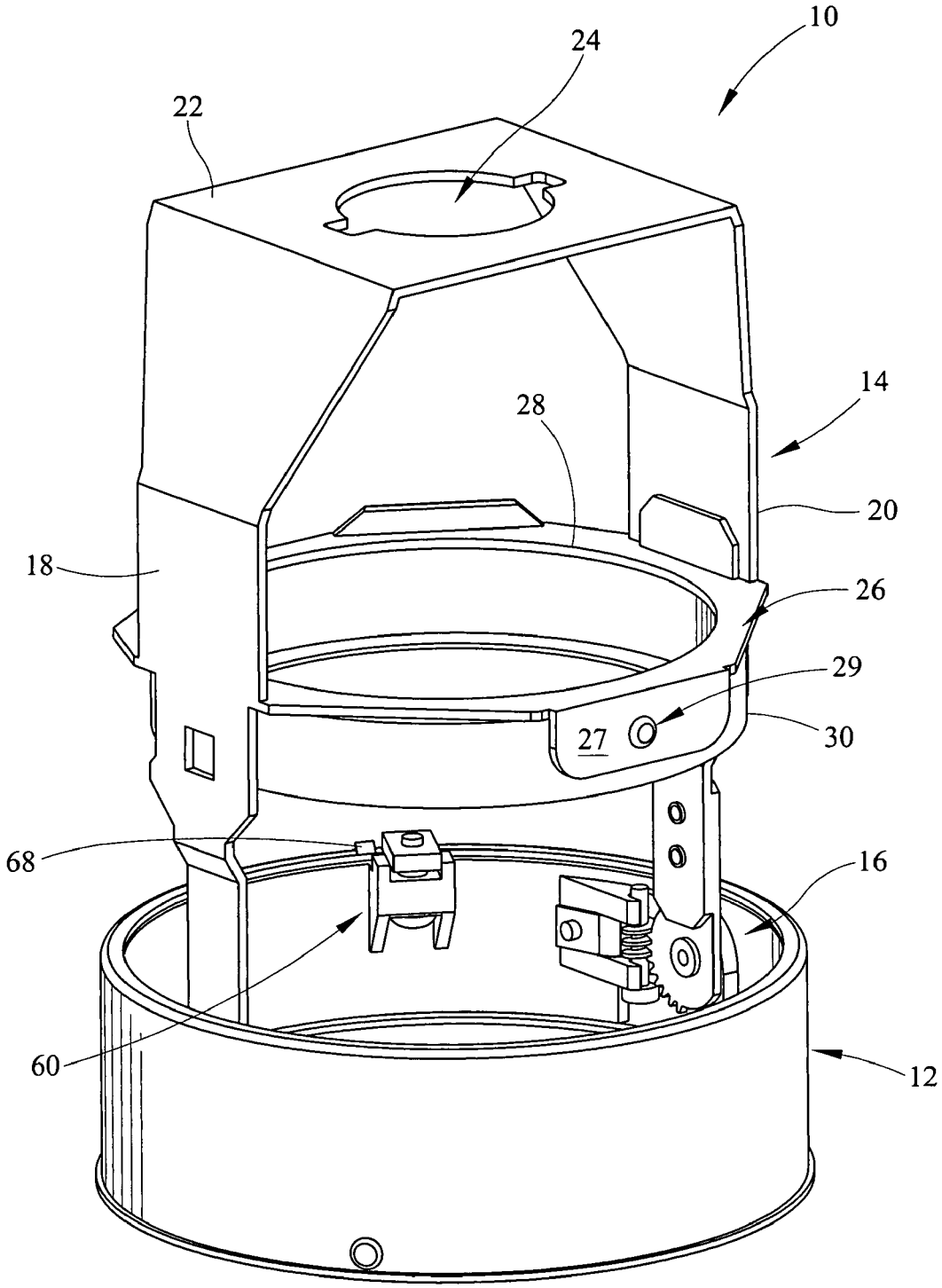
FIG. 1 depicts a perspective view of the worm gear drive aiming and locking mechanism of the present invention.

It should be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings. Furthermore, and as described in subsequent paragraphs, the specific mechanical configurations illustrated in the drawings are intended to exemplify embodiments of the invention however, other alternative mechanical configurations are possible which are considered to be within the teachings of the instant disclosure.

The present invention provides a structure for aiming and locking of a recessed downlight fixture in a pre-selected position. According to a first embodiment the adjustable downlight fixture allows for tilting rotation of an upper portion of the fixture about a horizontal axis. According to a second embodiment of the present design, the adjustable downlight fixture further comprises a lower collar assembly which allows rotation about a vertical axis and, therefore provides two axes of adjustment or aiming for the recessed downlight fixture.

The present invention comprises several advantages including aiming of the fixture without a user placing their hand near the high temperature of the light source or lamp. Even further, the aiming mechanism allows for movement of the light fixture about at least one axis and is self-locking once the user finishes aiming to prevent misalignment. Even further, the aiming and locking mechanisms may be adjusted without substantially blocking the light that the user is trying to aim.

Referring initially to FIG. 1, an adjustable recessed downlight fixture 10 is depicted in perspective view comprising a collar 12 and a yoke 14. The collar 12 is substantially cylindrical in shape and comprises a lower portion of the adjustable recessed lighting fixture 10. The collar 12 engages a ceiling aperture when the downlight fixture 10 is fully positioned in a ceiling structure. Alternatively, the collar 12 may be a rotating collar assembly 112, described further hereinafter. The yoke 14 is pivotally connected to the inner surface of the collar 12 for movement about a horizontal axis. A worm gear drive assembly 16 is located between the collar 12 and the yoke 14 for providing movement about the horizontal axis such that the yoke 14 may move between its upright position shown in FIG. 1 and a tilted position (FIG. 6) for proper aiming of the light source.

The yoke 14 is substantially U-shaped comprising first and second vertical legs 18, 20 extending from a pivotal connection with the collar 12. The yoke may be formed of multiple parts or may be a single integrally formed part. Extending between the first and second legs 18, 20 is an upper stiffening member 22 which provides some rigidity for the first and second legs 18, 20. The upper stiffening member 22 further provides a surface for positioning a lamp socket assembly (not shown). A mounting aperture 24 located in the upper stiffening member 22 provides a position for a lamp socket to extend through wherein a light source may be positioned to provide the downlight from the adjustable recessed downlight fixture 10. Although not shown, it should be understood that the lamp is disposed adjacent the lower surface of the stiffening member 22.

Figure 7:
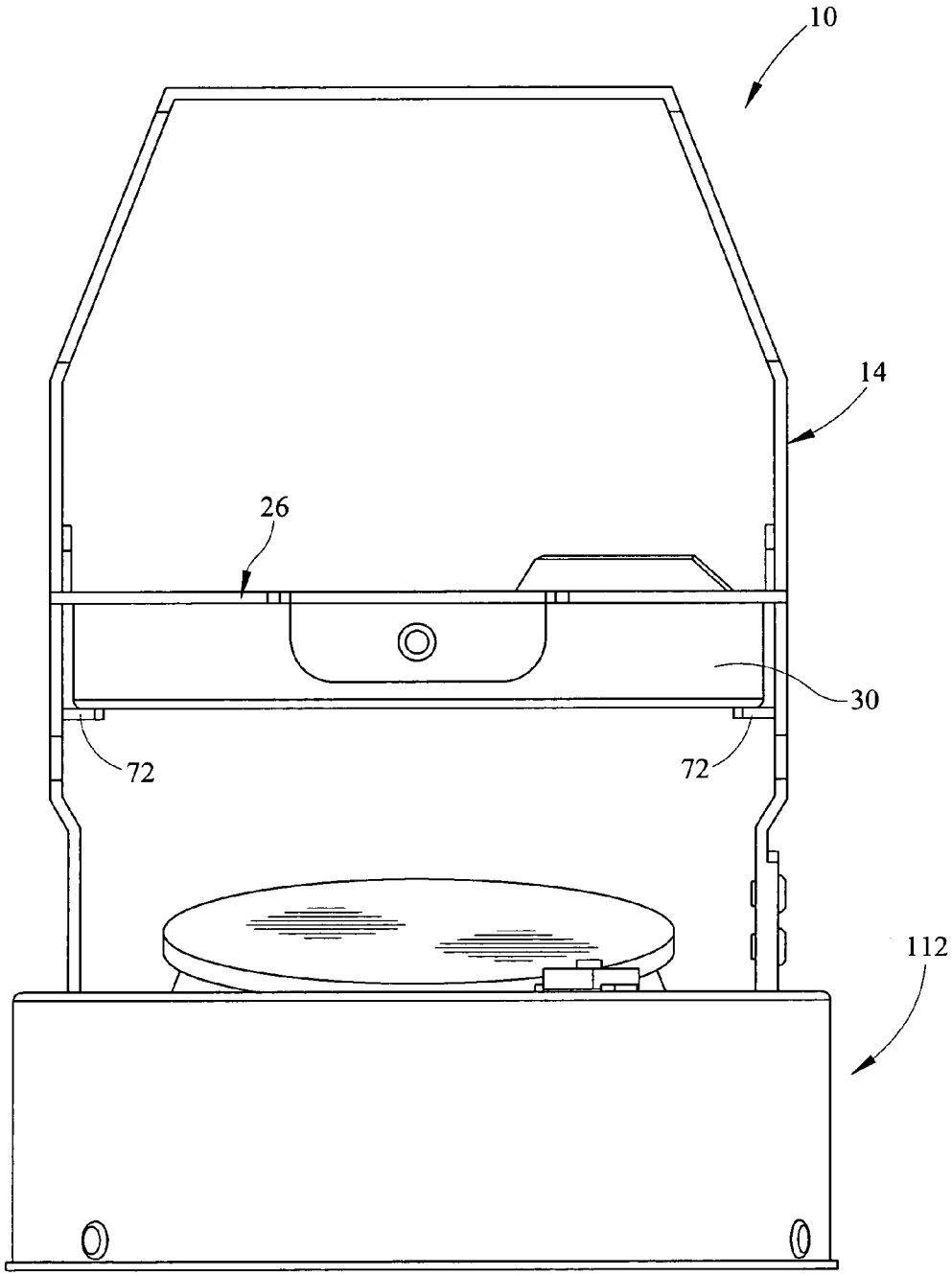
FIG. 7 is a side-view of the worm gear drive aiming and locking mechanism.

The first and second legs 18, 20 are spaced apart a distance which is equal to or less than the diameter of the collar 12 so that the adjustable recessed downlight fixture 10 may be placed upwardly through a ceiling aperture. This relationship between yoke width and collar diameter is best shown in FIG. 7. The ceiling aperture receives the collar 12 when the adjustable recessed lighting fixture 10 is fully inserted into the aperture and therefore the distance between the first and second legs 18, 20 must not be greater than the diameter of the collar 12. Otherwise, the legs 18, 20 would interfere with the ceiling aperture.

Also extending between the first and second legs 18, 20 is a filter cartridge retaining member 26 which is located at some position between the upper stiffening member 26 and the collar 12. According to the exemplary embodiment, the retaining member or stiffening ring 26 is positioned at about the middle of the vertical length of the first and second legs 18, 20 thus providing an additional benefit of further stiffening of the yoke 14. The member 26 also functions as an accessory support ring. In the embodiment shown in FIG. 1, the retaining member 26 is hexagonal in shape however alternative shapes may be utilized. The retaining member 26 further comprises an inner substantially circular shaped aperture 28 which allows light to pass through the retaining member 26 from the light source above and further pass through the collar 12. Located beneath the cartridge retaining member 26 is a filter cartridge 30 which will be described further herein.

Figure 2:
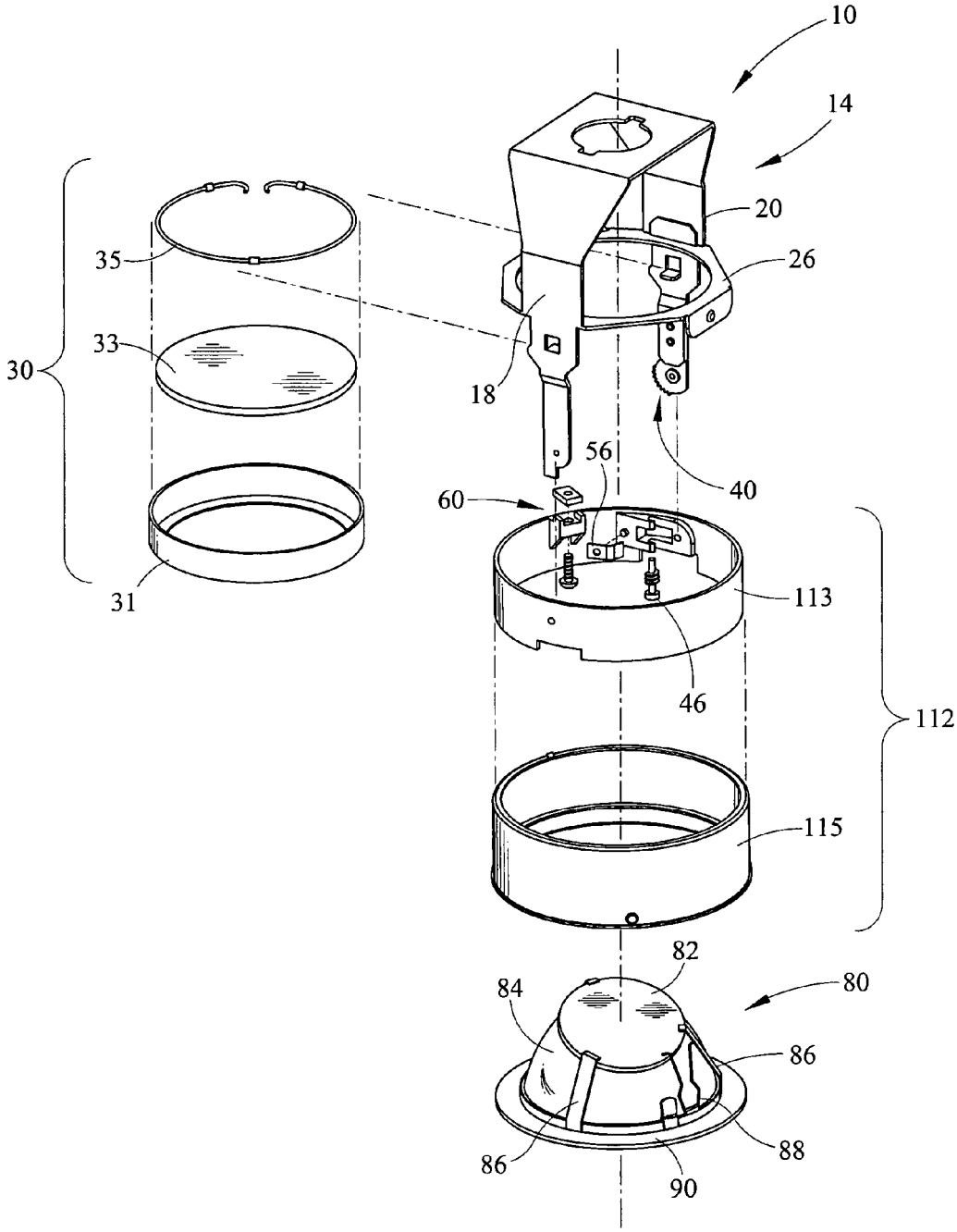
FIG. 2 depicts an exploded perspective view of the worm gear drive aiming and locking mechanism of FIG. 1.

As shown in FIG. 2, the fixture 10 further comprises a reflector assembly 80, including a lens 82, reflector 84 and lower trim 90. The lens 82 allows light to pass through to the reflector 84. The reflector 84 includes a polished finish for an aesthetically pleasing appearance to a person beneath the light. The lower trim 90 engages the collar 12 or rotating collar assembly 112 and the ceiling also providing an aesthetically pleasing finish. The lens clip 86 extends from the trim 90 to the lens 82 to retain the lens 82 in place. A retaining clip is also shown extending from the trim 90 which is used to provide a connection between the reflector assembly 80 and the fixture 10 such that the assembly 80 can hang from the fixture 10 during installation, re-lamping or adjustment of the fixture components.

Referring now to the tilting feature of the yoke 14 about a horizontal axis, the worm gear drive assembly 16 is shown in FIGS. 2-5. With reference initially to FIG. 2, the worm gear drive assembly 16 comprises a gear 40 at the lower end of one of the first and second legs 18, 20. The gear 40 is shown at lower end of second leg 20 in the instant embodiment. The gear 40 is flat and partially round in shape with a plurality of gear teeth 42 (FIG. 3) extending from the round portion. The gear 40 engages a worm 46 defining the worm gear drive assembly 16 (FIG. 1). The worm gear drive assembly 16 allows for movement of the yoke 14 about a horizontal axis to and from a substantially vertical orientation measured from a vertical axis extending through the adjustable recessed downlight fixture 10.

Figure 3:
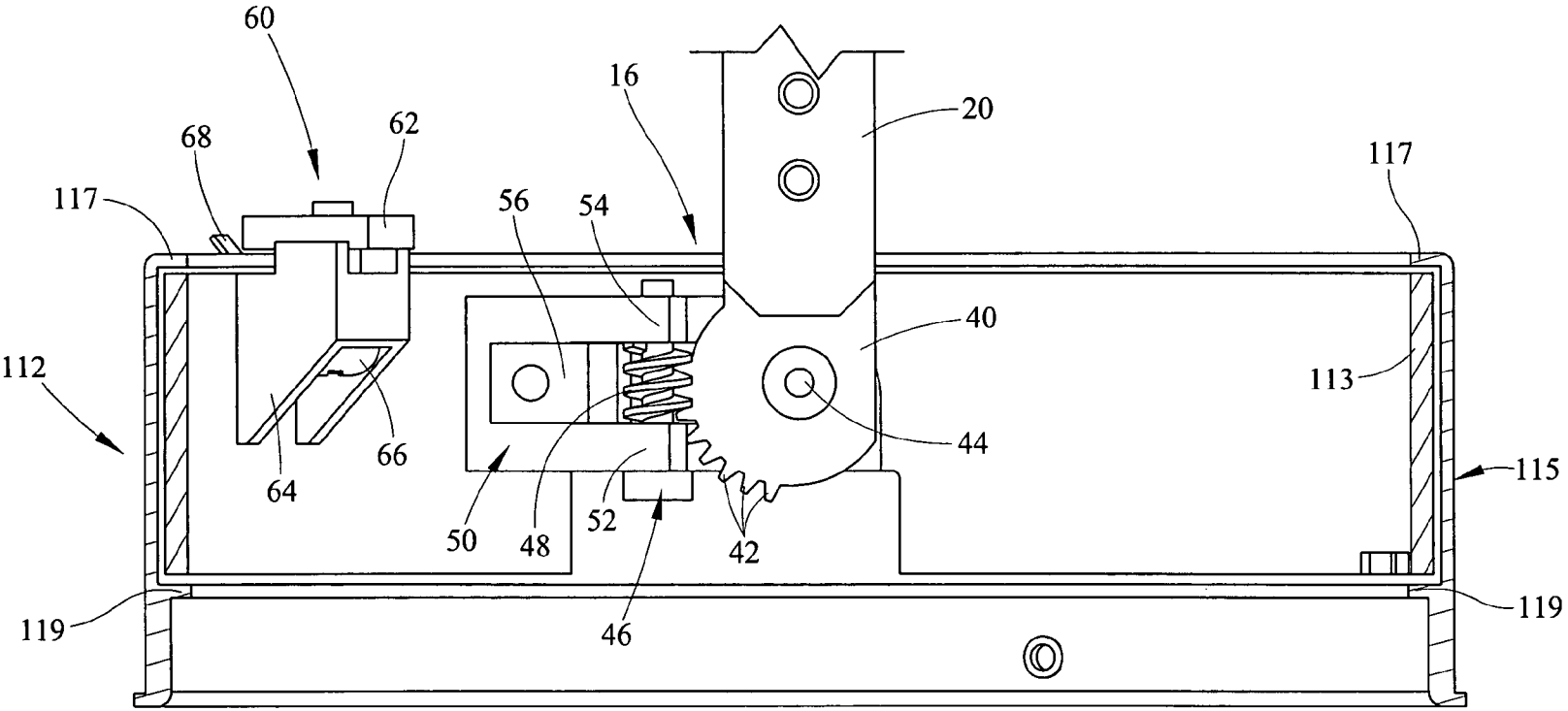
FIG. 3 depicts a side-sectional view of the worm gear drive aiming and locking mechanism of FIG. 1.

Referring now to FIG. 3, a side-sectional view depicting the worm gear drive assembly 16 is shown. The second leg 20 is connected to the gear 40 or may be integral therewith. The gear 40 is pivotally connected at pivot point 44 to a rotating collar assembly 112 described further herein. The gear 40 is substantially flat and has a partially circular shape through at least about 180°. Along the curved surface of the gear 40 are a plurality of teeth 44 which engage the worm 46. Although the design characteristics may vary, the exemplary gear 40 may have eight (8) teeth 42 covering about 120 degrees of the round portion of gear 40. The gear teeth 42 have a diametral pitch of 32 and a standard involute tooth form. The worm 46 comprises a helically extending worm thread 48 defining a plurality of teeth which engage the plurality of teeth 42 on the gear 40. The exemplary thread 48 may comprise a pitch of 0.1 or 10 threads per inch. At a lower end of the worm 46 is a head for receiving a fastening tool such as a screwdriver. The hand is placed at the lower end to provide easy access to an installer or other user adjusting the device. The head may alternatively be fitted to receive an Allen wrench, star wrench or other such rotating tool. As the head of worm 46 is turned with a fastening tool, the gear 40 pivots about pivot point 44 causing rotation of the yoke 14 about a horizontal axis.

Along the innermost surface of the collar assembly 112 is a casting 50 which comprises a first lower worm rib 52 and a second upper worm rib 54 which provide a seat for the worm 26. When the gear 40 is pivotally fastened at the pivot point 44 and the worm 46 is seated in the ribs 52, 54, the worm teeth 48 engage the gear teeth 42. The present design also provides that the gear 40 forces the worm 46 against the first and second worm ribs 52, 54. A biasing member 56 may be retained on or adjacent the casting 50 so as to provide an opposite biasing force on the worm 46 and maintain worm teeth 48 in engagement with the plurality of gear teeth 42 on gear 40. According to the instant exemplary embodiment, the biasing member 56 is a leaf spring bearing the worm 46 against the gear 40 to remove play or tolerance between the two pieces. In turn, this also helps the worm gear drive assembly 16 maintain the light output in its adjusted or aimed position once the adjustment of the worm 46 is completed.

Worm gears are typically used when large gear reductions are needed and further have the characteristic that other gear sets do not provide wherein the worm can easily turn the gear but the gear cannot turn the worm. Since the angle on the worm is so shallow that when the gear tries to spin the worm the friction between the gear and the worm holds the worm in place. Accordingly, this worm gear drive assembly 16 provides a locking feature for the yoke 14 such that once the worm 46 is adjusted the yoke 14 cannot move until the worm 46 is further moved by deliberate adjustment. This is because the moments applied at pivot point 44 cannot cause rotation of the gear relative to the worm 46.

Figure 4:
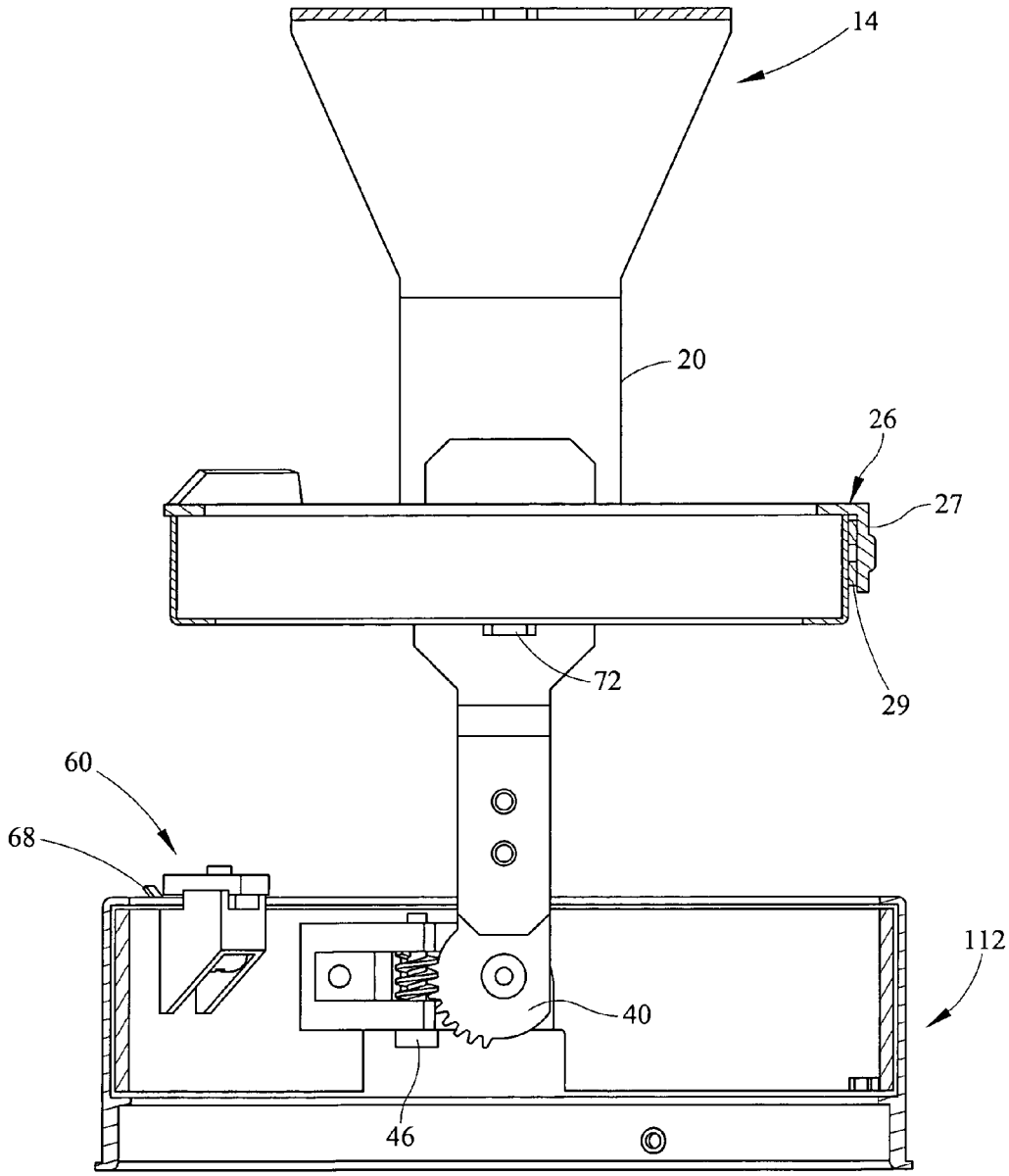
FIG. 4 also depicts a side-sectional view of the worm gear drive aiming and locking mechanism of FIG. 1 in an upright position.
Figure 5:
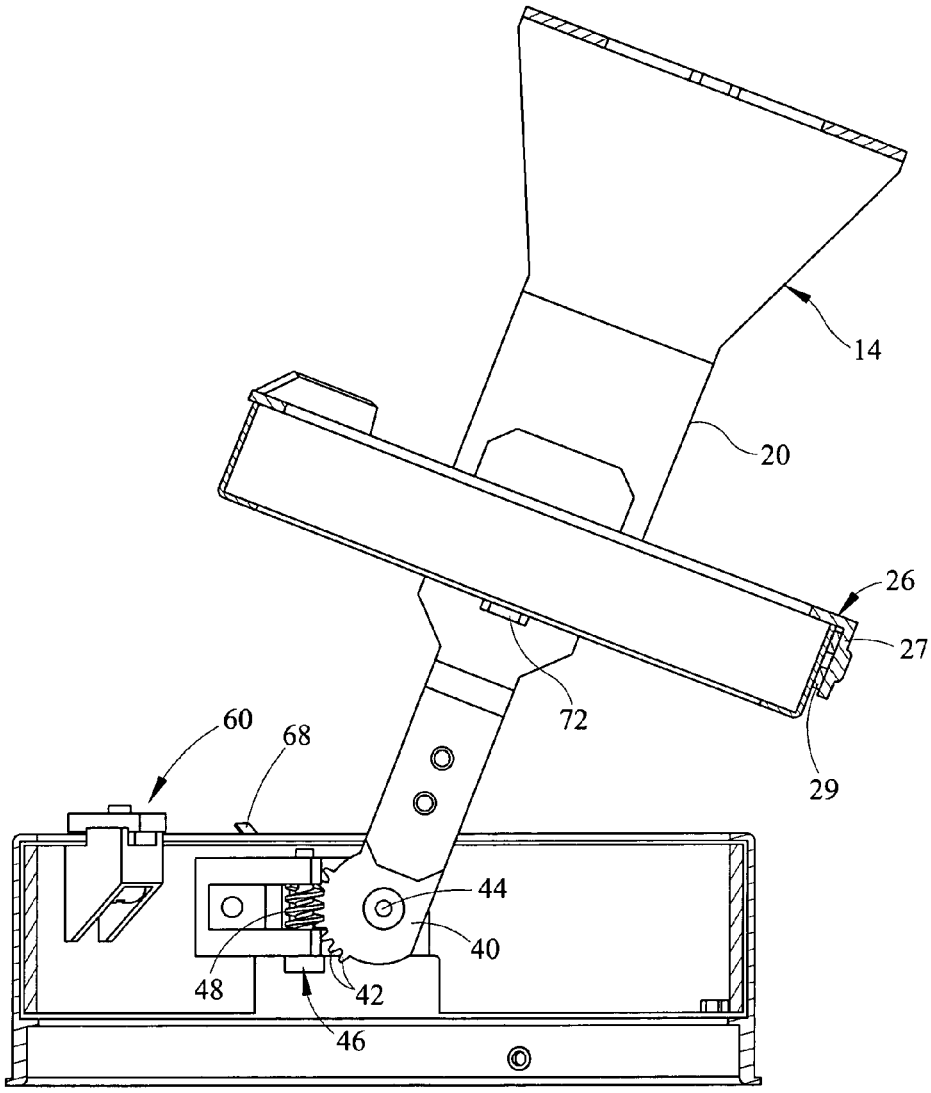
FIG. 5 depicts a side-sectional view of the worm gear drive aiming and locking mechanism of FIG. 4 in a tilted position.

Referring now to FIG. 4, the yoke 14 is shown in an upright position relative to the collar assembly 112. By rotating the worm 46, the gear 40 is driven so that the yoke 16 pivots about a horizontal axis at pivot point 44. As shown in FIG. 5 this yoke 14 has moved from its vertical orientation to an angled or tilted position. The lamp may be aimed to a desired position by rotation of the worm 46 while adjusts the yoke 14 about a horizontal axis at pivot point 44.

Figure 6:
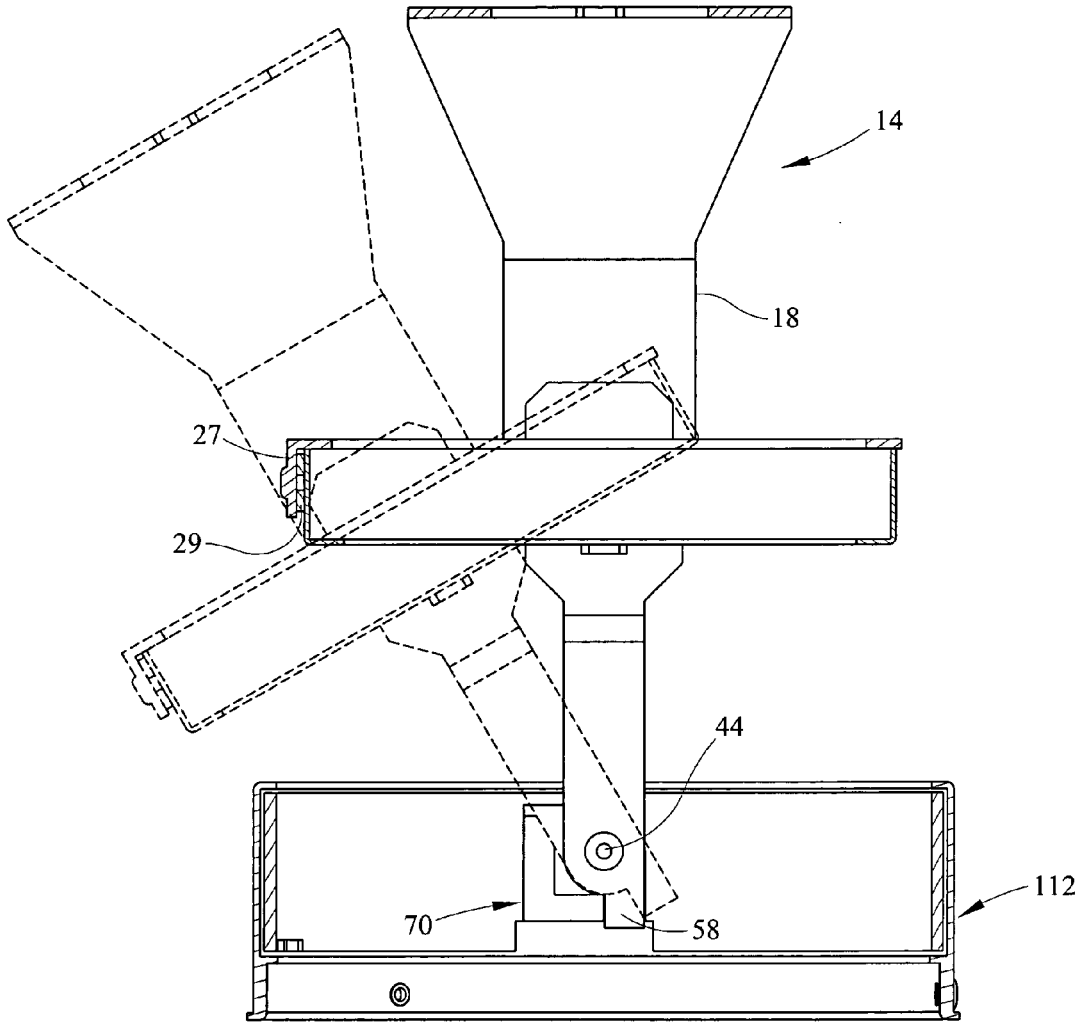
FIG. 6 depicts a side-sectional view of the opposite side of the worm gear drive aiming and locking mechanism of FIG. 4 wherein the yoke is shown in an upright position and as a tilted position in broken line.

Referring now to FIG. 6, the first leg 18 of the yoke 14 is again shown in the upright vertical position relative to the collar assembly 112. The first leg 18 is depicted as pivotally connected at pivot point 44 to the innermost surface of the rotating collar assembly 112. Beneath the pivot point 44 of the first leg 18 is an engagement protrusion 58 which engages a pivot stop 70 extending from the innermost surface of the rotating collar assembly 112. The pivot stop 70 is also a cast boss on the inner surface of inner race 113. As depicted in the exemplary embodiment, the pivot stop 70 is substantially L-shaped comprising a vertical leg and a horizontal leg. At an upper portion of the vertical leg is a tapered surface which engages the first leg 18 when the yoke is in a fully tilted position as shown in FIG. 6. The lower horizontal leg of the pivot stop 70 engages the protrusion 58 when the yoke 14 is moved clockwise to a fully upright, vertical position. Alternatively the pivot stop 70 may vary in shape and may comprise multiple pieces in order to vary the distance through which the yoke may pivot. According to one embodiment the yoke 14 may move through an angle of up to about 85 degrees from the vertical, and more preferably about 50 degrees. Thus, the shape and length of the legs of pivot stop 70 dictate the travel of the yoke 14.

Referring again to FIG. 1, the lower portion of the adjustable recessed downlight fixture 10 comprises a collar 12 which does not rotate. However, according to one embodiment of the instant invention, the fixture 10 alternatively comprises a rotating collar assembly 112 (FIGS. 2-8) which rotates about a vertical axis. Since the yoke 14 is connected to the rotating collar assembly 112, the yoke 14 may also be rotated about a vertical axis. Accordingly, the yoke 14 may be tilted from the vertical in either direction by first rotating the collar assembly 112 then turning the worm gear drive assembly 16. Such construction effectively doubles the yoke's arcuate range about the horizontal axis. In order to effectuate rotation about a vertical axis the rotating collar assembly 112 comprises an inner race 113 and an outer race 115. The yoke 14 is fastened at opposed pivot points 44 (FIGS. 3 and 6) on the inner race 113 in order to provide the pivoting motion of the yoke 14 about a horizontal axis extending between the pivot points 44. Further, since the yoke 14 is connected to the inner race 113, and the inner race 113 rotates about a vertical axis relative to the outer race 115, the yoke 14 is therefore also about a vertical axis giving the adjustable recessed downlight fixture 10 two degrees of freedom. The two degrees of freedom improve aiming of the lamp.

Referring again to FIG. 3, the outer race 115 comprises an upper rib 117 and a lower rib 119 which are substantially circular in shape and have a vertical wall extending therebetween. The upper and lower ribs 117, 119 extend radially inward from outer race 115 defining a channel wherein the inner race 113 is located and provides rotation relative to the outer race 115. The inner race 113 has a diameter which is larger than the inner diameter formed by the upper and lower ribs 117, 119 of the outer race 115. Accordingly, the inner race 113 is captured within the channel formed by the outer race 115 providing for rotation of the inner race 113 and the yoke 14 connected thereto, relative to the outer race 115.

As further shown in FIG. 3, the inner race 113 defines the innermost surface of the rotating collar assembly 112. Accordingly, various components are formed on the inner surface of the inner race 113 including the casting 50 as well as the pivot stop 70 (FIG. 6). Further, the first leg and second leg 18, 20 are pivotally connected to the inner race 113 at the pivot points 44. Such connection may be made with a fastener such as a rivet or other fastening device, which does not interfere with the rotation between the inner race 113 and the outer race 115. And, since the yoke 14 is connected to the inner race 113, the yoke 14 is adjustable about two orthogonal axes.

As previously described the worm gear drive assembly 16 is a self-locking mechanism. Since the rotating collar assembly 112 also rotates there is a need to lock the assembly when adjustment is complete. Accordingly, a brake assembly 60 is utilized to stop rotation between the inner race 113 and the outer race 115 when the installer or user has adjusted the yoke 14 to a desired position for providing light. The brake assembly 60 comprises an upper brake pad 62, a brake casting 64 and a brake fastener 66. The brake casting 64 is integrally formed with the inner race 113 and extends radially inward from an innermost surface of the inner race 113. A vertical fastening aperture extends through the casting 64. The brake fastener 66 extends upwardly through the brake casting 64 and fastening apertures to threadably engage the brake pad 62 and to fasten the brake pad 62 to the brake casting 64. The brake pad 62 is substantially rectangular in shape with a threaded fastening aperture therein. Upon tightening of the brake fastener 66 the brake pad 62 moves downwardly along the threads of the brake fastener 66 so as to engage the upper lip of outer race 115. As the brake pad 62 engages the upper lip of the outer race 115, a downward friction force is applied to the outer race 115 inhibiting further rotation. As one of ordinary skill in the art will understand, such configuration connects the inner race to the outer race inhibiting relative motion therebetween and therefore inhibiting rotation of the inner race 113 relative to the outer race 115. Further one of ordinary skill in the art should recognize that the brake pad 62 is sized so not to extend beyond the outer diameter of the collar assembly 112. This configuration prevents interference of the pad 62 with the ceiling aperture during installation or operation of the fixture 10 and constitutes an undesirable problem.

Referring now to FIGS. 1 and 3-5, a rotation stop 68 is also shown adjacent the brake 60. As one of skill in the art will understand, due to the rotation provided by collar assembly 112, the wiring within the fixture 10 may become twisted. In order to prevent detrimental twisting the rotation stop 68 has been provided. The rotation stop 68 extends from an upper surface of the outer race 115 and specifically extends from the upper rib 117. The rotation stop 68 engages the brake pad 62 so as to limit the rotation of the inner race relative to the outer race to about 360°. The rotation stop 68 limits the rotation of the inner race 113 to this pre-selected angular distance in order to inhibit twisting of wiring within the fixture 10. If wire twisting occurs such over-rotation and twisting may result in disconnection or loose connection of wiring which would inhibits proper operation of the light. As depicted in FIGS. 3-5 and 8 the stop 68 is shown in different positions indicating rotation of the outer race 15 relative to the inner race 113.

Referring now to FIGS. 1, 2 and 4-7, the cartridge retaining member 26 extends between the first leg 18 and the second leg 20 of the yoke 14. The cartridge retaining member 26 first serves as a mounting bracket for the filter cartridge assembly 30. The cartridge retaining member 26 also provides further rigidity between the first and second legs in order to increase the structural integrity of the yoke 14. The cartridge retaining member 26 comprises at least one tab 27 which provides a positive engagement surface for a filter cartridge assembly 30. The tab 27 is located in a plane which is transverse to the legs 18, 20 and between legs 18,20. On an inside surface of the tab 27 is a magnet 29 which is shown by way of the connecting fastener on the outer surface of the tab 27 in FIG. 1. Alternatively the magnet 29 may be adhered to the cartridge retaining member 26. The magnet 29 limits horizontal movement of the cartridge assembly 30 in one direction because the magnet 29 retains the cartridge assembly 30 against the tab 27. Horizontal movement parallel to the tab 27 is limited by the legs 18, 20 of yoke 14.

Extending from the inner surfaces of the first and second legs 18, 20 are feet 72 which in combination with the magnet 29 on the filter cartridge retaining member 26 retain a filter cartridge assembly 30 between the first and second legs 18, 20 of yoke 14. As shown clearly in FIGS. 4-7, the cartridge feet 72 support the weight of the cartridge assembly 30 and the magnet 29 retains the filter cartridge assembly 30 against the tab 27 for proper positioning within the yoke 14. Further, upward movement of the cartridge assembly 30 is inhibited by the member 26. The magnet 29 is located on a surface which is perpendicular to the plane of the feet 71 and the legs 18,20. Thus, by the exemplary construction the cartridge assembly 30 is captured in five directions and can only move in a horizontal direction away from the magnet 29 and tab 27.

Figure 8:
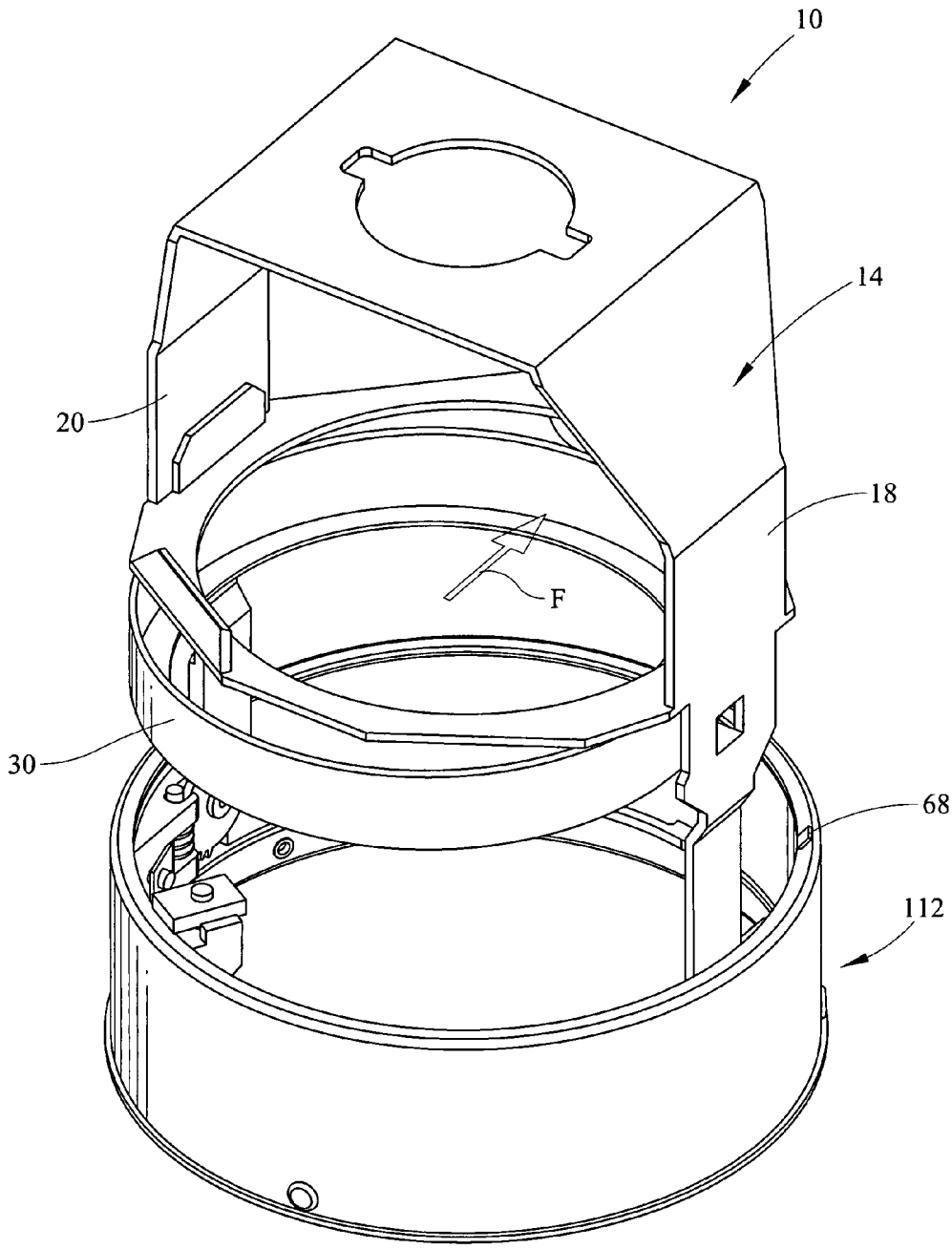
FIG. 8 is a perspective view of the worm gear drive aiming and locking mechanism with the filter cartridge being inserted therein.

The filter cartridge assembly 30, as shown in FIG. 2, comprises a filter cartridge 31, a light filter 33, and a retaining spring 35. The filter cartridge 31 is substantially cylindrical in shape and has a central aperture defined by a lower lip to allow light to pass through the cartridge 31 to the light filter 33. The lower lip has a smaller diameter than an upper opening of the cartridge 31. The light filter 33 fits within the filter cartridge 31 against the lower lip portion of the filter cartridge 31. The lower lip portion of the filter cartridge 31 provides a seat for the light filter 33. Above the light filter 33 is a retaining spring which has a diameter greater than the filter cartridge 31 and is squeezed to decrease the diameter for positioning within the filter cartridge 31 and against the light filter 33. Once released, the retaining spring 35 expands to push against the sidewalls of the filter cartridge 31 thus retaining the light filter 33 in the cartridge 31. Alternatively stated, the light filter 33 is captured between the cartridge 31 below and the retaining spring 35 above. Use of the cartridge assembly 30 use is optional and may be desirable when special lighting effect is necessary such as light having a specific color. The filter cartridge assembly 30 is also shown in FIG. 8 being inserted into the yoke 14. The filter cartridge assembly 30 has a diameter which is slightly less than the diameter of the rotating collar assembly 112. Accordingly, the filter cartridge assembly 30 is positioned for operation by a movement upwardly through the lower portion of the rotating collar assembly 112 and is angled so that the lower surface of the filter cartridge assembly 30 is positioned on the feet 72. Once the filter cartridge assembly 30 is positioned on the feet 72, a force is applied to the filter cartridge assembly 30 to slide the assembly along the feet 72 toward the magnet 29 on tab 72 as indicated by the arrow F. The filter cartridge 31 is metallic and therefore is attracted to the magnetic force of the magnet 29. Alternatively, a magnet may also be placed on the filter cartridge 31 which has an equal attractive force on the tab 27 or both the tab and the magnet 29 so as to retain the filter cartridge assembly 30 in place relative to the yoke 14 and filter cartridge retaining member 26. With a slight application of force on the cartridge assembly 30 opposite arrow F to break the magnetic attraction, the assembly 30 may be removed by angling the cartridge 31 once it is clear of the feet 72. The exemplary design also allows the filter 31 to be changed without removal of the fixture 10 from the ceiling as well as maintaining a safe distance from the lamp so not to burn the user.

The foregoing description of several methods and an embodiment of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. An adjustable recessed downlight assembly:

a collar;

a yoke having at least one leg, said at least one leg pivotally connected to said collar such that said yoke is adjustable through an arcuate distance about a horizontal axis relative to said collar;

a worm gear drive assembly, including at least one gear, operably engaging said yoke and said collar for pivoting said yoke about said horizontal axis;

said at least one gear defining a pivot point of said at least one leg;

said yoke and said worm gear drive assembly pivoting about a vertical axis relative to said collar.

2. The adjustable downlight assembly of claim 1, said worm gear drive assembly further comprising a worm.

3. The adjustable downlight assembly of claim 2, said worm gear drive assembly being adjustable by rotation of said worm.

4. The adjustable downlight assembly of claim 1 further comprising a biasing member fastened to a casting, said casting extending from an inner surface of said collar.

5. The adjustable downlight assembly of claim 1, said worm gear drive assembly inhibiting unintentional movement of said yoke.

6. The adjustable downlight assembly of claim 5, said downlight assembly adjustable about first and second axes.

7. The adjustable downlight assembly of claim 1, said collar being a rotating collar assembly.

8. The adjustable downlight assembly of claim 7, said collar assembly comprising an outer race and an inner race, wherein said inner race rotates relative to said outer race.

9. The adjustable downlight assembly of claim 7, said collar assembly further comprising a brake.

10. The adjustable downlight assembly of claim 7, said collar assembly further comprising a rotation stop limiting rotation of said collar assembly to a preselected angular distance and inhibiting wire twisting.

11. The adjustable downlight assembly of claim 10, said rotation stop extending from one of said inner race and said outer race.

12. The adjustable downlight assembly of claim 1 further comprising a filter cartridge retaining member.

13. The adjustable downlight assembly of claim 12, said filter cartridge retaining member extending between first and second legs of said yoke.

14. The adjustable downlight assembly of claim 12, said filter cartridge retaining member comprising a magnet for retaining a filter cartridge.

15. An adjustable downlight aiming fixture, comprising:

a fixture first portion adjustable about a first axis;

a fixture second portion adjustable about a second axis which is non-parallel with said first axis;

said fixture first portion connected to said fixture second portion;

said fixture first portion and said second portion operably connected by a worm gear drive assembly for aiming a recessed downlight about said second axis, said worm gear drive assembly located on said first fixture portion for pivoting about said first axis;

wherein said worm gear drive assembly rotates about said first axis and causes pivoting motion of said second fixture portion about said second axis.

16. The adjustable downlight aiming fixture of claim 15, said first axis being orthogonal to said second axis.

17. The adjustable downlight aiming fixture of claim 15, said first axis being a vertical axis and said second axis being a horizontal axis.

18. The adjustable downlight aiming fixture of claim 15, said first portion comprising a rotating collar assembly.

19. The adjustable downlight aiming fixture of claim 18, said rotating collar assembly having a first race and a second race, said first race rotating relative to said second race.

20. The adjustable downlight aiming fixture of claim 15 further comprising a worm and a gear.

21. The adjustable downlight aiming fixture of claim 20, said worm retained between a biasing member and a gear.

22. The adjustable downlight aiming fixture of claim 21 wherein rotation of said worm causes rotation of said gear.

23. The adjustable downlight aiming fixture of claim 15, said first portion comprising a rotating collar assembly and said second portion comprising a yoke.

24. The adjustable downlight aiming fixture of claim 23, said rotating collar assembly and a connection between said rotating collar assembly and said yoke providing two degrees of freedom for said yoke.

25. An adjustable downlight aiming fixture, comprising:

a collar defining a first portion of an adjustable downlight fixture;

a yoke having at least one leg, said leg pivotally connected to said collar;

a worm gear drive assembly controlling pivotal motion about a horizontal axis between said collar and said yoke through an arcuate distance;

said at least one leg connected to said worm gear drive assembly at a first pivotal connection of said yoke and said collar;

said collar providing a second pivotal rotation of said yoke about a vertical axis at one of an inner or outer periphery of said collar;

said worm gear drive assembly locking at a specific position when said worm gear drive assembly stops.

26. The adjustable downlight aiming fixture of claim 25, said worm gear drive assembly being adjustable at a preselected distance from a lamp to inhibit burning of a user.

27. The adjustable downlight aiming fixture of claim 25, said worm gear drive assembly being adjustable without substantially blocking the output light from said fixture.

28. The adjustable downlight aiming fixture of claim 25 further comprising a worm and a gear operably engaged.

29. The adjustable downlight aiming fixture of claim 28, said worm captured between a casting and said gear.

30. The adjustable downlight aiming fixture of claim 29, said worm biased toward said gear by a biasing member.

31. An adjustable downlight assembly, comprising:

a collar;

a yoke adjustable through an arcuate distance, said yoke pivotally connected to said collar for pivotal motion about a vertical axis;

a worm gear drive assembly positioned on said collar, wherein said worm gear drive assembly moves about said vertical axis and operably engages said yoke for pivoting said yoke about a horizontal axis;

wherein said worm gear drive assembly comprises a worm and a gear, said gear defining a pivot point about said horizontal axis.

* * * * *